US008434590B2

(12) United States Patent
Keck

(10) Patent No.: US 8,434,590 B2
(45) Date of Patent: May 7, 2013

(54) MUFFLER

(75) Inventor: Mathias Keck, Esslingen (DE)

(73) Assignee: J. Eberspaecher GmbH & Co., KG, Esslingen (DE)

( * ) Notice: Subject to any disclaimer, the term of this patent is extended or adjusted under 35 U.S.C. 154(b) by 0 days.

(21) Appl. No.: 13/277,914

(22) Filed: Oct. 20, 2011

(65) Prior Publication Data

US 2012/0097478 A1 Apr. 26, 2012

(30) Foreign Application Priority Data

Oct. 20, 2010 (DE) ..... 10 2010 042 679

(51) Int. Cl.
*F01N 13/08* (2010.01)

(52) U.S. Cl.
USPC ..... 181/228; 181/241; 181/263

(58) Field of Classification Search ..... 181/228, 181/241, 263
See application file for complete search history.

(56) References Cited

U.S. PATENT DOCUMENTS

| | | | | |
|---|---|---|---|---|
| 5,119,902 | A * | 6/1992 | Geddes | 181/206 |
| 5,336,856 | A * | 8/1994 | Krider et al. | 181/206 |
| 5,444,197 | A * | 8/1995 | Flugger | 181/264 |
| 5,446,790 | A * | 8/1995 | Tanaka et al. | 381/71.14 |
| 5,574,264 | A * | 11/1996 | Takemori et al. | 181/206 |
| 5,600,106 | A | 2/1997 | Langley | |
| 5,619,020 | A | 4/1997 | Jones et al. | |
| 2006/0236973 | A1 * | 10/2006 | Seibt et al. | 123/198 E |
| 2008/0053747 | A1 * | 3/2008 | Krueger et al. | 181/206 |
| 2011/0005857 | A1 * | 1/2011 | Pommerer et al. | 181/212 |

FOREIGN PATENT DOCUMENTS

| | | | |
|---|---|---|---|
| DE | 197 51 596 | A1 | 6/1999 |
| DE | 200 14 194 | U1 | 1/2002 |
| DE | 10 2005 011 747 | B3 | 6/2006 |
| DE | 10 2006 042 224 | B3 | 1/2008 |
| EP | 0 483 921 | A1 | 5/1992 |
| EP | 674097 | A1 * | 9/1995 |
| EP | 0 916 817 | A2 | 5/1999 |
| EP | 1 627 996 | A1 | 2/2006 |
| JP | 06323122 | A * | 11/1994 |
| JP | 2008-031936 | A | 2/2008 |

* cited by examiner

*Primary Examiner* — Forrest M Phillips
(74) *Attorney, Agent, or Firm* — Reinhart Boerner Van Deuren P.C.

(57) ABSTRACT

The present invention relates to a muffler (8) for an exhaust system (6) of a combustion engine (1), more preferably of a motor vehicle, with a housing (14) comprising at least one exhaust gas inlet (18) and at least one exhaust gas outlet (19), with a pipe arrangement (20) for conducting exhaust gas arranged in the housing (14), which comprises at least one pipe section (21) running within the housing (14), and with a hollow space (22) formed in the housing (14), which is present in addition to the pipe arrangement (20) and is connected to said pipe arrangement at least for the airborne sound transmission.

22 Claims, 3 Drawing Sheets

MUFFLER

CROSS-REFERENCE TO RELATED PATENT APPLICATIONS

This patent application claims priority to German Application No. 102010042679.2, filed Oct. 20, 2010, the entire teachings and disclosure of which are incorporated herein by reference thereto.

FIELD OF THE INVENTION

The present invention relates to a muffler for an exhaust system of a combustion engine. Furthermore, the present invention relates to an associated usage. Sound absorption with combustion engines is relevant predominantly in mobile applications, e.g. in vehicles, but also in stationary applications, such as for instance with block heating and power plants.

BACKGROUND OF THE INVENTION

In the case of mufflers, active mufflers and passive mufflers are distinguished. Active mufflers have an electroacoustic converter, which as a rule is formed by a loudspeaker and with which the anti-noise is generated, which with appropriate phase shift leads to a more or less effective cancellation of the sound to be muffled. Using electroacoustic converters, the sound emission can be likewise designed specifically in that certain frequencies are increasingly emitted. In particular, a sound design can be realized with such an active muffler. It is conceivable for example to generate the sound emission of a six-cylinder gasoline engine with a four-cylinder diesel engine.

Such an electroacoustic converter usually comprises a vibratory diaphragm which can be excited into vibrations with the help of an actuator. Furthermore, a cage, which defines the diaphragm and on which the actuator is fastened, is usually provided in addition. With this cage, the converter or the loudspeaker can be fastened to a housing of the muffler.

In contrast with this, a passive muffler works with absorption and/or reflection and/or resonance. Likewise, mixed forms, with which a loudspeaker for active sound attenuation is installed in a passive muffler or with which an active muffler is additionally equipped with resonance and/or absorption and/or reflection chambers, are also realizable in principle.

The present invention deals with the problem of stating an improved embodiment for a muffler of the type mentioned at the outset, which is more preferably characterized by low manufacturing costs and/or by a compact design.

SUMMARY OF THE INVENTION

According to the invention, this problem is solved through the subjects of the independent claims. Advantageous embodiments are the subject of the dependent claims.

The invention is based on the general idea of using a vibratory wall section of a housing of a muffler as diaphragm of an electroacoustic converter, which can be excited into vibrations with the help of an actuator. Through a suitable activation of the actuator, pressure pulsations can be introduced into the exhaust gas flow via the wall section of the housing, e.g. as anti-vibrations in order to cancel out to a greater or lesser degree the sound to be combated and/or as vibrations, in order to amplify missing or weak sound. Deviating from the conventional procedure wherein a complete electroacoustic converter with cage, actuator and own diaphragm is installed in the housing of the muffler, the muffler according to the invention manages without additional diaphragm since with the help of the actuator a wall section already present on the housing is used for generating the pressure pulsations. Because of this, the manufacturing costs are reduced. Here it is clear that the wall section coupled to the actuator can be specifically selected or designed in such a manner that it is particularly suited for generating pressure pulsations. Thus, the wall section can be of a vibratory design, e.g. through a wall thickness that is reduced compared with the wall of the remaining housing and/or changed material selection.

The wall section coupled to the actuator delimits a hollow space of the housing to the outside, which is present in the housing in addition to a pipe arrangement and at least for the airborne sound transmission is connected to this pipe arrangement. The pipe arrangement arranged in the housing serves for conducting exhaust gas and comprises at least one pipe section running within the housing. The exhaust gas flow conducted in the pipe arrangement transports airborne sound, which also enters the hollow space. A control device for the active sound design, i.e. for the active muffling and/or for the active sound generation or sound amplification can now actuate the actuator such that with the help of the wall section, pressure pulsations can be introduced into the hollow space which with regard to the noises to be absorbed are suitably phase-shifted and lead to an attenuation through mutual cancellation, or which lead to the desired sound amplification. Mixed forms are also possible, so that first frequencies are attenuated and second frequencies are amplified in order to achieve the desired sound.

The housing of the muffler can have a cylindrical jacket and two end bottoms, wherein the actuator is practically connected to one of the end bottoms for introducing vibrations. Here, the housing can be embodied in wrap-around design or in tubular design or in shell design.

In the case of a cylindrical jacket the end bottoms have a round cross section, so that they are particularly suited for the introduction of vibrations. The end bottom connected to the actuator can have a smaller wall thickness and/or consist of a material other than the jacket and/or than the other end bottom. Because of this, the vibratory capability of the end bottom used as diaphragm can be improved.

In order to improve the vibratory capability of the end bottom or its diaphragm character it can be provided according to an advantageous embodiment to equip the respective end bottom with a circumferential bottom margin, wherein the end bottom in the region of its bottom margin is fastened to the jacket, wherein the end bottom within its bottom margin comprises a diaphragm region and a border which encloses the diaphragm region and whose stiffness is greater than the stiffness of the diaphragm region, wherein the actuator is connected to the diaphragm region for introducing vibrations. Such an end bottom can be particularly easily produced from one piece, for example through deep-drawing.

With an alternative design, the housing can be embodied in shell design and comprise at least two shells which are fastened to each other, wherein the actuator is connected to one of the shells for introducing vibrations. Such shells can be produced unitarily particularly in an integral manner, for example through deep-drawing. It is particularly advantageous here if the respective has a circumferential shell margin, wherein the shell in the region of its shell margin is fastened to the at least one other shell, wherein the shell within its shell margin comprises a diaphragm region and a border which encloses the diaphragm region and whose stiffness is greater than the stiffness of the diaphragm region, wherein the actuator is connected to the diaphragm region for introducing vibrations. This measure, too, leads to an improvement of the diaphragm characteristic of the wall section coupled to the actuator, which improves the introduction of the desired pressure pulsations into the hollow space. Here, too, the integral design of the respective shell is advantageous, since sealing problems for example do not occur.

In general, hence, according to an advantageous embodiment the respective wall section comprises a diaphragm region connected to the actuator for the introduction of vibrations, and a border which encloses the diaphragm region and whose stiffness is greater than the stiffness of the diaphragm region. Different stiffness's in the border and in the diaphragm region can be realized for example by providing the border with at least one stiffening corrugation, while the diaphragm region is free of stiffening corrugations. Additionally or alternatively, it can be provided that a wall thickness of the respective wall section is smaller in the diaphragm region than in the border. Additionally or alternatively, it can be provided that at least one stiffening element is attached to the border.

Particularly advantageous is an embodiment, with which the actuator is arranged outside on the housing. In this manner, the actuator is not exposed to the hot exhaust gases at any time, which substantially reduces the thermal load on the actuator. Accordingly, elaborate cooling measures can be omitted. However, as an alternative it is also possible in principle to arrange the actuator inside on the housing. This can be advantageous with respect to a protection from contaminations.

The control device for the active sound influencing can also be called ANC-control, wherein ANC stands for Active Noise Control. This control device or the ANC-control can, according to an advantageous embodiment, activate the respective actuator as a function of input signals which are generated by a sensor device for sensing the airborne sound transported in the exhaust gas connected to the control for signal transmission or which are generated by an engine control for operating a combustion engine connected to the control for signal transmission. In other words, the control device on the one hand can work together with a sensor device, e.g. in the form of a microphone, in order to form a closed loop circuit or a closed loop control. A direct correlation between the sound to be influenced and the pressure pulsations generated with the help of the actuator is made via such a closed loop control. On the other hand, the control device can be supplied with signals which correlate to the noise development of the combustion engine through being coupled to the engine control. Usually, there is a close correlation between load and/or rotational speed of the combustion engine and the noises that develop in the process. Because of this it is likewise possible to establish a control circuit or a control, with which the actuation of the actuator correlates merely indirectly to the sound to be attenuated.

It is likewise possible that the control device is coupled both to such a sensor device as well as to the engine control in order to actuate the respective actuator in a kind of mixed operation with open loop circuit and closed loop circuit. For example, a coarse tuning of the active sound influencing can be achieved within the scope of an open loop control while a fine tuning of the active sound influencing is realized via a closed loop control.

With another embodiment, the pipe arrangement can comprise at least one perforated pipe section, which is arranged in the hollow space, in order to make possible the transmission of airborne sound between the exhaust gas transported in the pipe section and the hollow space. Alternatively, the pipe arrangement can comprise at least one pipe section which in the hollow space comprises an inflow opening or an outflow opening in order to achieve a sound-transmitting coupling between the pipe arrangement and the hollow space via the respective opening.

Practically, the hollow space can be formed by an expansion chamber or by a resonance chamber which is acoustically coupled to the pipe arrangement. More preferably it can be provided here that the hollow space forms a region in the housing which is not subjected to any throughflow. The respective expansion chamber or resonance chamber is then arranged in parallel. Additionally or alternatively the hollow space can form a region subjected to throughflow in the housing, for example in the form of a deflection chamber. In this case, the hollow space additionally includes a flow guiding function.

Practically, the actuator can be supported on a cage which in turn is supported on the housing. Practically, the cage in this case supports itself on the housing outside the wall section serving as diaphragm. If the wall section serving as diaphragm is formed for example by an end bottom of the housing, the cage practically supports itself on the bottom margin or on the jacket. Provided that the wall section has a diaphragm region with border, the cage practically supports itself outside the border.

Thus, the present invention generally relates also to a usage of a wall section of a housing of a muffler for an exhaust system of a combustion engine that is present anyhow, particularly of a motor vehicle, as diaphragm for an electroacoustic converter of a device for the active sound influencing, that is for the active sound generation or sound amplification or for the active sound attenuation.

In another advantageous embodiment the exhaust gas inlet defines an inlet direction for the exhaust gas flow and the exhaust gas outlet defines an outlet direction for the exhaust gas flow, wherein the exhaust gas inlet and the exhaust gas outlet are orientated to each other such that the inlet direction and the outlet direction enclose an angle greater than 0°. In particular said angle can be at least 90°. Preferably, the angle between the inlet direction and the outlet direction is about 90° or about 180°.

The present invention relates to a muffler for an exhaust system of a combustion engine, more preferably of a motor vehicle, with a housing comprising at least one exhaust gas inlet and at least one exhaust gas outlet, with a pipe arrangement for conducting exhaust gas arranged in the housing, which comprises at least one pipe section running within the housing, and with a hollow space formed in the housing, which is present in addition to the pipe arrangement and is connected to said pipe arrangement at least for the airborne sound transmission.

A cost-effective solution for the active sound influencing can be achieved with at least one actuator which for generating pressure pulsations in the at least one hollow space is connected to a wall section of the housing delimiting the respective hollow space to the outside for introducing vibrations, and with a control device for the active sound influencing which is connected to the at least one actuator for its actuation.

Further important features and advantageous of the invention are obtained from the subclaims, from the drawings and from the associated Figure description by means of the drawings.

It is to be understood that the features mentioned above and still to be explained in the following cannot only be used in the respective combination stated, but also in other combinations or by themselves without leaving the scope of the present invention.

BRIEF DESCRIPTION OF THE DRAWINGS

Preferred exemplary embodiments of the invention are shown in the drawings and are explained in more detail in the following description, wherein same reference characters refer to same or similar or functionally same components.

It shows, in each case schematically.

DETAILED DESCRIPTION OF THE INVENTION

Figure 1:
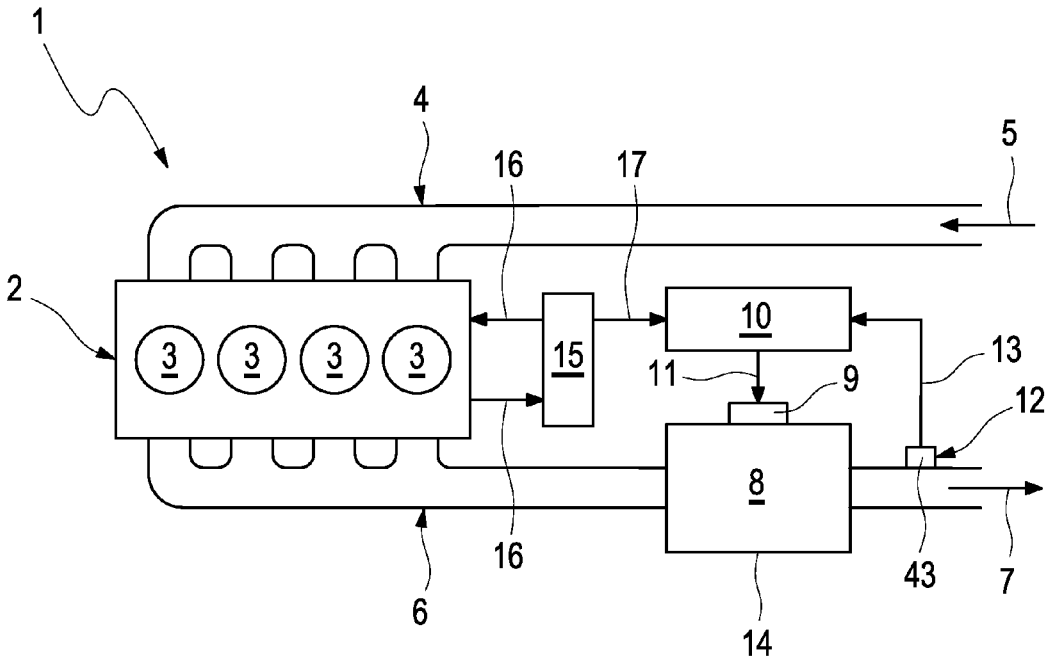
FIG. 1 is a highly simplified schematic representation in the manner of a circuit diagram of a combustion engine with a muffler.

According to FIG. 1, a combustion engine 1, which is preferably arranged in a motor vehicle, comprises an engine block 2, with a plurality of cylinders 3, in which pistons which are not shown are adjustably arranged. Accordingly, this concerns a piston engine. The combustion engine 1 comprises a fresh air system 4 which feeds the fresh air 5 or a fresh air flow 5 to the cylinders 3. Furthermore, an exhaust system 6 is provided, which discharges exhaust gas 7 or an exhaust gas flow 7 from the cylinders 3.

In the exhaust system 6, a muffler 8 comprising an actuator 9 is arranged. Furthermore, a control device 10 is assigned to the muffler 8 which is coupled to the actuator 9 via a control line 11. The control device 10 serves for actuating the actuator 9. Furthermore, a sensor device 12 is shown in FIG. 1, which is connected to the control device 10 via a signal line 13. The sensor device 12 can sense the airborne sound transported in the exhaust gas 7 and by doing so generate correlated signals, feeding them to the control device 10. The sensor device 12 comprises at least one sensor 43, which for example can be embodied as a microphone. In the example, the sensor 43 is connected to the exhaust system 6 downstream of the muffler 8. It is clear that in principle the sensor 43 can also be positioned differently, for example directly on a housing 14 of the muffler 8. Likewise, the sensor device 12 can comprise a plurality of sensors 43.

In the example of FIG. 1, an engine control 15 is additionally shown which serves for operating the combustion engine 1 and is connected to corresponding components of the combustion engine 1 via suitable lines 16. Furthermore, a signal line 17 is provided which connects the engine control 15 to the control device 10. In this manner, the control device 10 receives information or signals which correlate to the airborne sound transported in the exhaust gas 7.

For example, the airborne sound transported in the exhaust gas 7 can be estimated with respect to the frequencies and/or amplitudes by means of the current load and/or rotational speed of the combustion engine 1. At any rate, the control device 10 can be configured such that it activates the actuator 9 as a function of input signals received by the control device 10 from the sensor device 12 and/or from the engine control 15.

According to FIGS. 2 to 5, the muffler 8 on its housing 14 comprises at least one exhaust gas inlet 18 and at least one exhaust gas outlet 19. Through the exhaust gas inlet 18, the exhaust gas 7 enters the housing 14 and through the exhaust gas outlet 19 the exhaust gas 7 again leaves the housing 14. In the housing 14 a pipe arrangement 20 is additionally arranged which serves for conducting exhaust gas and which comprises at least one pipe section 21 which runs within the housing 14. Furthermore, at least one hollow space 22 is formed in the housing 14. Said hollow space 22 is provided in the housing 14 in addition to the pipe arrangement 20 and is in connection with the pipe arrangement 20 at least for the airborne sound transmission. There is thus an acoustic coupling in terms of airborne sound between hollow space 22 and pipe arrangement 20. In particular, at least one part of the pipe arrangement 20 runs within the hollow space 22.

As already mentioned with respect to FIG. 1, the muffler 8 additionally comprises at least one actuator 9, which for example can be operated electromagnetically or electrically. The actuator 9 is connected with a wall section 23 of the housing 14 in such a manner that the actuator 9 can excite said wall section 23 for generating vibrations or pressure pulsations in the hollow space 22. To this end, said wall section 23 delimits the previously mentioned hollow space 22 to the outside. Through the excitation of the wall section 23 into vibrations by the actuator 9, pressure vibrations, that is pressure pulsations can be generated in the gas volume in the hollow space 22. This can be carried out with the help of the control device 10 specifically so that an active sound design takes place, wherein certain frequencies are attenuated and other defined frequencies are generated or amplified. Alternatively, active sound generation only or sound amplification only can also be realized. Likewise, only active sound attenuation by means of anti-noise can also be realized alternatively.

Accordingly, the control device 10 is preferably an ANC-control, which in the following is likewise designated 10. It is remarkable that for realizing the active muffler 8 introduced here no complete electroacoustic converter, particularly loudspeaker, has to be installed into the housing 14, on the contrary, the active muffler 8 introduced here manages without additional diaphragm since said wall section 23 of the housing 14 is used as diaphragm, which can be excited into vibrations with the help of the actuator 9.

Figure 2:
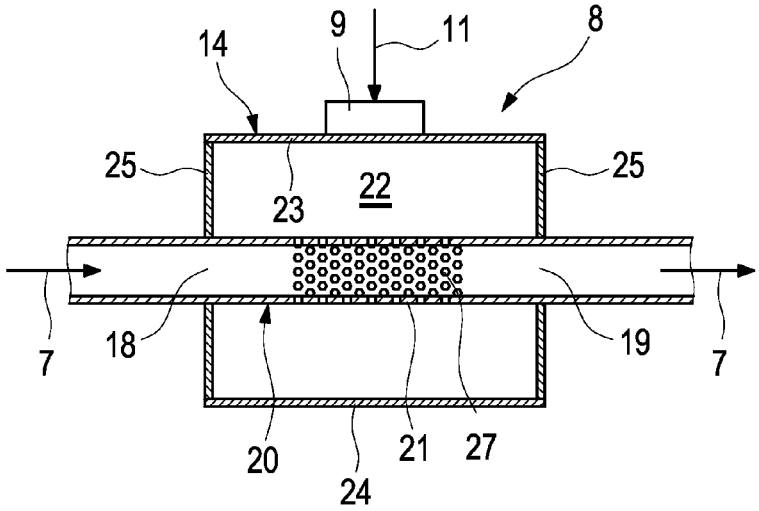
FIGS. 2 to 5 are a highly simplified longitudinal section of an exhaust system in the region of a muffler with different embodiments each.
Figure 3:
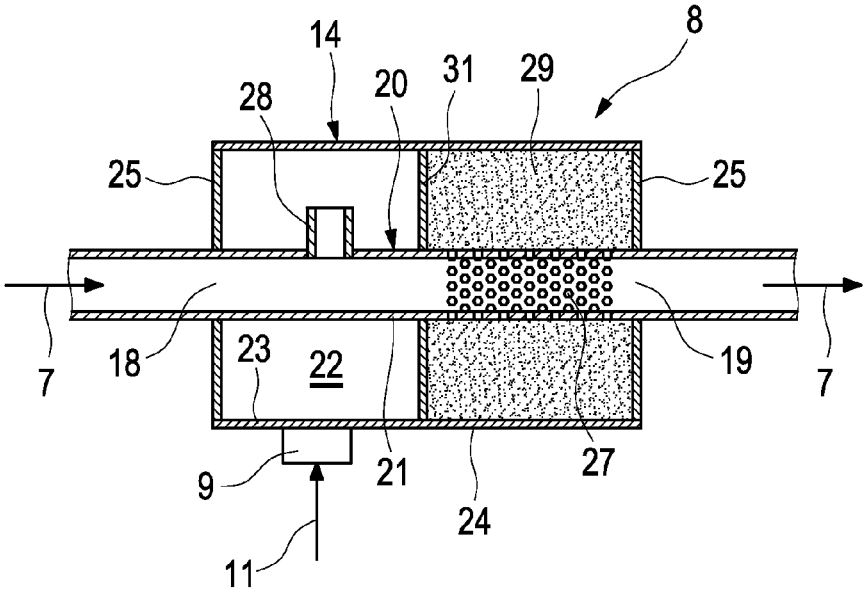
Figure 4:
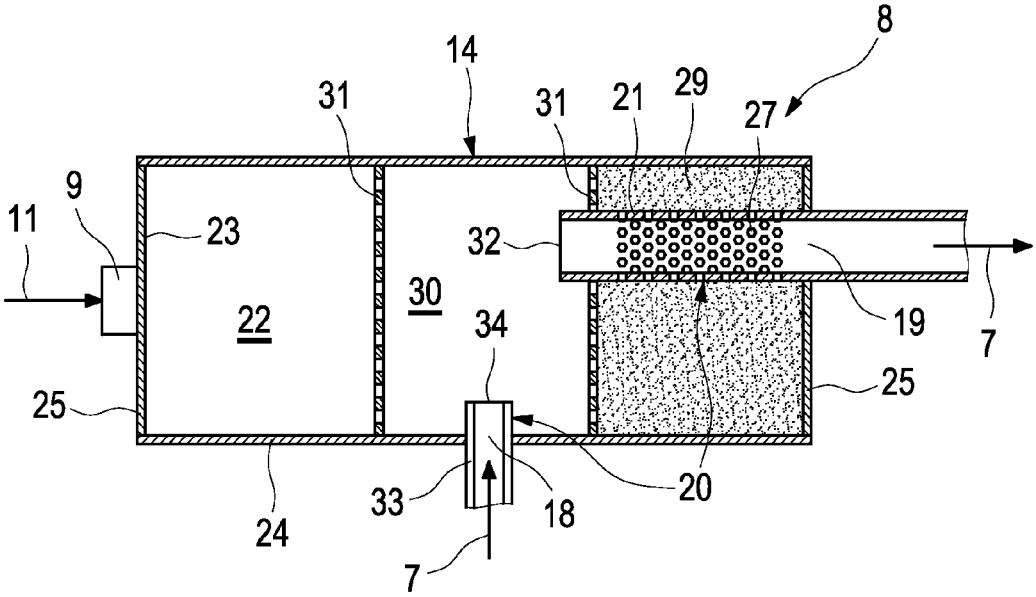

With the embodiments of FIGS. 2 to 5, the housing 14 has a cylindrical jacket 24 and two end bottoms 25 which close off the cylindrical jacket 24 at its longitudinal ends. Such a housing can be embodied in wrap-around design so that the jacket 24 is formed by a sheet metal length which is wrapped at least by 360° in the circumferential direction in order to form the jacket 24. Alternatively, the housing 14 can be embodied in tubular design so that the jacket 24 is formed by a pipe body. Both with the wrap-around design as well as with the tubular design the end bottoms 25 are attached to the jacket 24. Alternatively, the housing 14 can also be embodied in shell design. In this case, the housing 14 comprises at least two shells 26 of which one is exemplarily shown in FIG. 6. With the shell design, no end bottoms 25 are usually employed. The housing 14 is then assembled from the individual shells 26, for the purpose of which the individual shells are fastened together. With the embodiments shown in FIGS. 2, 3 and 5, the wall section 23 is formed on the jacket 24 so that the actuator 9 is also attached to the jacket 24. In contrast with this, FIG. 4 shows an embodiment with which the wall section 23, to which the actuator 9 is coupled, is formed on one of the end bottoms 25 or is formed by one of the end bottoms 25.

Figure 5:
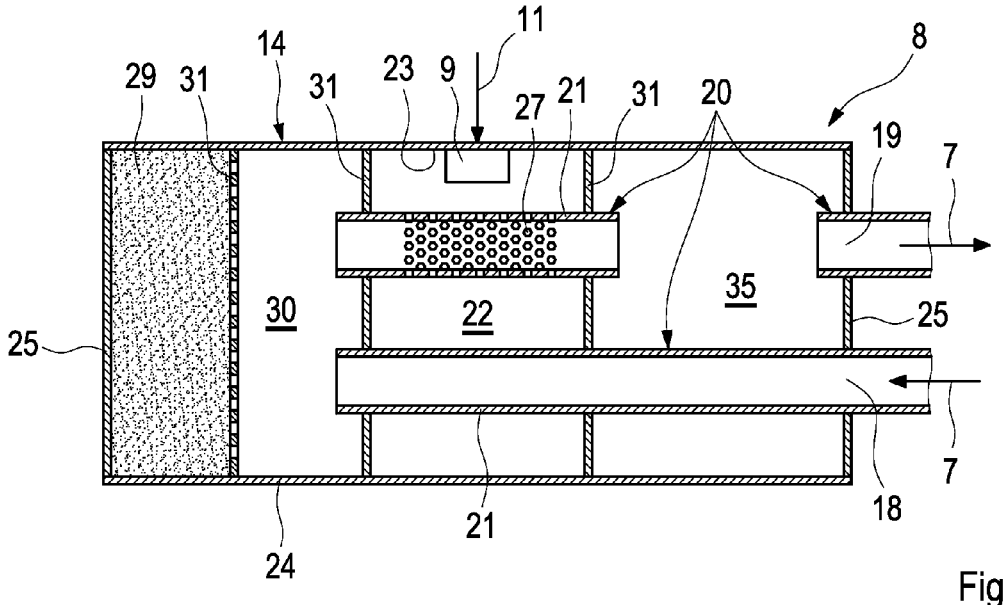

With the embodiments of FIGS. 2, 3 and 4 the actuator 9 is arranged outside on the housing 14, so that the actuator 9 is not exposed to the hot exhaust gases 7. In contrast with this, FIG. 5 shows an embodiment wherein the actuator 9 is arranged inside on the housing 14.

With the embodiment shown in FIG. 2, the pipe section 21 has a perforation 27 which creates an acoustic coupling between pipe arrangement 20 and hollow space 22. In this case, the hollow space 22 serves as expansion chamber. In this case, the hollow space 22 forms a region within the housing 14 that is not subjected to a throughflow.

With the embodiment shown in FIG. 3, the hollow space 22 is formed by a resonance chamber which is acoustically coupled to the pipe arrangement 20 via a connecting pipe 28. In this case, the hollow space 22 is likewise not subjected to a throughflow of the exhaust gas 7. The resonance chamber forms a resonance volume of a Helmholtz resonator, whose neck is formed by the connecting pipe 28. Furthermore, an absorption chamber 29 is provided with the embodiment shown in FIG. 3, in which an absorption material, a so-called sound absorption material can be arranged. In the region of the absorption chamber 29 the pipe section 21 is likewise equipped with a perforation 27 for airborne sound coupling.

With the embodiment shown in FIG. 4, the housing 14 likewise contains an absorption chamber 29 that can be filled with absorption material, a deflection chamber 30 as well as an expansion chamber, which forms the hollow space 22.

Here, the individual chambers are separated from one another through separating walls 31, which can be perforated. In this case, the hollow space 22 can also be provided in a region of the housing 14 not subjected to a throughflow. If the separating wall 31 between hollow space 22 and deflection chamber 30 is absent, the combined volume forms the deflection chamber 30, wherein in that case the deflection chamber 30 additionally forms the hollow space 22. In this case, the hollow space 22 is subjected to throughflow. The pipe arrangement 20 in that case comprises a pipe section 21, which in the hollow space 22 has an inflow opening 32 and a pipe section 33, which in the hollow space 22 has an outflow opening 34.

With the embodiment shown in FIG. 5, an absorption chamber 29, which can be filled with an absorption material, a deflection chamber 30, the hollow space 22 in the form of an expansion chamber as well as a further expansion chamber 35 or reflection chamber 35 can be arranged in the housing 14 purely exemplarily. The pipe section 21 again has a perforation 27 for the acoustic coupling between pipe arrangement 20 and hollow space 22. At least the separating wall 31 between absorption chamber 29 and deflection chamber 30 is perforated. The other separating walls 31 can be gas-tight.

Figure 6:
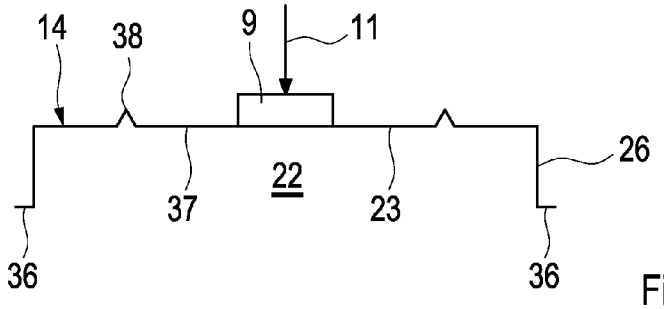
FIGS. 6 to 8 are highly simplified sectional views of the muffler in the region of an actuator with different embodiments.

According to FIG. 6, the actuator can be arranged on one of the shells 26 of the housing 14 embodied in shell design. The actuator 9 in this case is connected to the wall section 23 of the shell 26 for introducing vibrations. With the special exemplary embodiment shown in FIG. 6, the shell 26 has a circumferential shell margin 36 with which the shell 26 can be fastened to another shell of the housing 14. Within this shell margin 36, the shell 26 comprises a diaphragm region 37 and a border 38. The border 38 encloses the diaphragm region 37, that is the border 38 encloses the diaphragm region 37. The stiffness of diaphragm region 37 in this case is less than the stiffness of the border 38. The actuator 9 is now connected to the diaphragm region 37 for introducing vibrations. The shell 26 equipped with the actuator 9 can have a smaller wall thickness, at least in the diaphragm region 37, than the at least one further shell of the housing 14 embodied in shell design.

Figure 7:
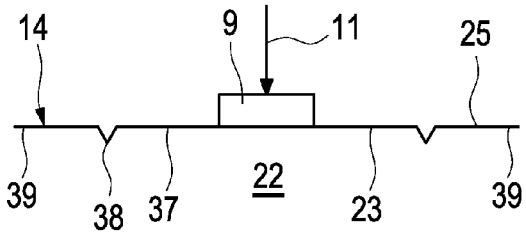

With the embodiment shown in FIG. 7, the actuator 9 is connected to one of the end bottoms 25 for introducing vibrations. With this special embodiment the end bottom 25 comprises a circumferential bottom margin 39 with which the end bottom 25 can be fastened to the jacket 24. Within the bottom margin 39, the end bottom 25 comprises a diaphragm region 37 and a border 38 which encloses the diaphragm region 37. The stiffness of the border 38 in this case is also selected greater than the stiffness of the diaphragm region 37. The end bottom 25 equipped with the actuator 9 can have a lesser wall thickness at least in the diaphragm region 37 than the other end bottom 25 and/or than the jacket 24.

Figure 8:
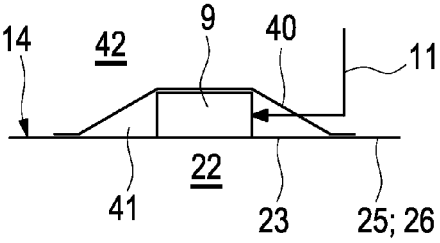

FIG. 8 now shows a further special embodiment wherein the actuator 9 is supported on a cage 40. This cage 40 in turn is supported on the housing 14. Depending on the attachment position of the actuator 9, the cage 40 is supported for example outside the respective border 38 on the respective shell 26 or on the respective end bottom 25. With the actuator 9 mounted to the end bottom 25, the cage 40 can for example be supported on the jacket 24. With the respective wall section 23, the cage 40 delimits a receiving space 41, in which the actuator 9 is arranged and which is open towards a surrounding area 42 of the actuator 9.

In general, hence, according to an advantageous embodiment the respective wall section 23 comprises a diaphragm region 37 connected to the actuator 9 for the introduction of vibrations, and a border 38 which encloses the diaphragm region 37 and whose stiffness is greater than the stiffness of the diaphragm region 38. Different stiffness's in the border 38 and in the diaphragm region 37 can be realized for example by providing the border 38 with not depicted stiffening corrugations, while the diaphragm region 37 is free of stiffening corrugations. Additionally or alternatively, it can be provided that a wall thickness of the respective wall section 23 is smaller in the diaphragm region 37 than in the border 38. Additionally or alternatively, it can be provided that at least one stiffening element not shown is attached to the border 38.

The exhaust gas inlet 18 defines an inlet direction for the exhaust gas flow and the exhaust gas outlet 19 defines an outlet direction for the exhaust gas flow, wherein the exhaust gas inlet 18 and the exhaust gas outlet 19 are orientated to each other such that the inlet direction and the outlet direction enclose an angle greater than 0°. In particular said angle can be at least 90°. Preferably, the angle between the inlet direction and the outlet direction according to FIG. 4 is about 90° and according to FIG. 5 is about 180°.

The invention claimed is:

1. A muffler for an exhaust system (6) of a combustion engine (1), particularly of a motor vehicle, comprising:

a housing (14) having at least one exhaust gas inlet (18) and at least one exhaust gas outlet (19), a pipe arrangement (20) arranged in the housing (14) for conducting exhaust gas, which at least comprises a pipe section (21) running within the housing (14), at least one hollow space (22) formed in the housing (14), which is present in addition to the pipe arrangement (20) and with which the latter is connected at least for the airborne sound transmission, at least one actuator (9), which for generating pressure pulsations in the at least one hollow space (22) is connected to a wall section (23) of the housing (14) delimiting the respective hollow space (22) for the introduction of vibrations, a control device (10) for the active sound influencing, which is connected to the at least one actuator (9) for the actuation of the latter.

2. The muffler according to claim 1, wherein the housing (14) comprises a cylindrical jacket (24) and two end bottoms (25), wherein the actuator (9) is connected to one of the end bottoms (25) for introducing vibrations.

3. The muffler according to claim 2, wherein the housing (14) is embodied in wrap-around design or in tubular design or in shell design.

4. The muffler according to claim 2, wherein the respective end bottom (25) has a circumferential bottom margin (39), wherein the end bottom (25) in the region of its bottom margin (39) is fastened to the jacket (24), wherein the end bottom (25)

within its bottom margin (39) comprises a diaphragm region (37) and a border (38) which encloses the diaphragm region (37) and whose stiffness is greater than the stiffness of the diaphragm region (37), wherein the actuator (9) is connected to the diaphragm region (37) for introducing vibrations.

5. The muffler according to claim 1, wherein the housing (14) is embodied in shell design and comprises at least two shells (26), which are fastened to each other, wherein the actuator (9) is connected to one of the shells (26) for introducing vibrations.

6. The muffler according to claim 5, wherein the respective shell (26) comprises a circumferential shell margin (36), wherein the shell (26) is fastened to the at least one other shell (26) in the region of its shell margin (36), wherein the shell (26) within its shell margin (36) comprises a diaphragm region (37) and a border (38) which encloses the diaphragm region (37) and whose stiffness is greater than the stiffness of the diaphragm region (37), wherein the actuator (9) is connected to the diaphragm region (37) for the introduction of vibrations.

7. The muffler according to claim 1, wherein the respective wall section (23) comprises a diaphragm region (37) connected to the actuator (9) for the introduction of vibrations, and a border (38) which encloses the diaphragm region (37) and whose stiffness is greater than the stiffness of the diaphragm region (37).

8. The muffler according to claim 7, wherein the border (38) is provided with at least one stiffening corrugation, while the diaphragm region is free of stiffening corrugations.

9. The muffler according to claim 7, wherein a wall thickness of the respective wall section (23) is smaller in the diaphragm region (37) than in the border (38).

10. The muffler according to claim 7, wherein at least one stiffening element is attached to the border (38).

11. The muffler according to claim 1, wherein the actuator (9) is arranged outside on the housing (14), or wherein the actuator (9) is arranged inside on the housing (14).

12. The muffler according to claim 1, wherein the control device (10) activates the respective actuator (9) as a function of input signals which are generated by a sensor device (12) connected to the control device (10) for signal transmission for sensing the airborne sound transported in the exhaust gas or which are generated by an engine control (15) connected to the control device (10) for signal transmission for operating the combustion engine (2).

13. The muffler according to claim 1, wherein the pipe arrangement (20) comprises at least one perforated pipe section (21), which is arranged in the hollow space (22), or the pipe arrangement (20) comprises at least one pipe section (21) which forms a connecting pipe (28) in the hollow space (22) or comprises an inflow opening (34) or an outflow opening (32).

14. The muffler according to claim 1, wherein the hollow space (22) is formed through an expansion chamber or through a resonance chamber which is acoustically coupled to the pipe arrangement (20).

15. The muffler according to claim 14, wherein the hollow space (22) in the housing (14) forms a region that is not subjected to a throughflow.

16. The muffler according to claim 1, wherein the hollow space (22) in the housing (14) forms a region subjected to a throughflow.

17. The muffler according to claim 1, wherein the hollow space (22) in the housing (14) forms a region in the form of a deflection chamber (30) subjected to a throughflow.

18. The muffler according to claim 1, wherein the actuator (9) is supported on a cage (40) which in turn is supported on the housing (14).

19. The muffler according to claim 1, wherein the active sound influencing comprises at least one of an active sound attenuation, an active sound generation, or sound amplification.

20. The muffler according to claim 1, wherein the exhaust gas inlet (18) defines an inlet direction for the exhaust gas flow and the exhaust gas outlet (19) defines an outlet direction for the exhaust gas flow, wherein the exhaust gas inlet (18) and the exhaust gas outlet (19) are orientated to each other such that the inlet direction and the outlet direction enclose an angle greater than 0°.

21. The muffler according to claim 20, wherein the angle between the inlet direction and the outlet direction is at least 90° or wherein the angle between the inlet direction and the outlet direction is 90° or 180°.

22. A use of a wall section (23) of a housing (14) of a muffler (8) of an exhaust system (6) of a combustion engine (1) that is present anyhow, more preferably of a motor vehicle as diaphragm for an electroacoustic converter of a device for active sound influencing.

* * * * *